US011220817B2

(12) United States Patent
Hortom

(10) Patent No.: US 11,220,817 B2
(45) **Date of Patent: *Jan. 11, 2022**

(54) METAL ROOFING SYSTEM

(71) Applicant: Southeastern Metals Manufacturing Company, Inc., Jacksonville, FL (US)

(72) Inventor: James W. Hortom, Jacksonville, FL (US)

(73) Assignee: SOUTHEASTERN METALS MANUFACTURING COMPANY, INC.

( * ) Notice: Subject to any disclaimer, the term of this patent is extended or adjusted under 35 U.S.C. 154(b) by 5 days.

This patent is subject to a terminal disclaimer.

(21) Appl. No.: 17/019,307

(22) Filed: Sep. 13, 2020

(65) Prior Publication Data

US 2020/0407971 A1 Dec. 31, 2020

Related U.S. Application Data

(63) Continuation of application No. 15/819,078, filed on Nov. 21, 2017, now Pat. No. 10,815,657, which is a (Continued)

(51) Int. Cl.
*E04B 1/61* (2006.01)
*E04D 12/00* (2006.01)

(Continued)

(52) U.S. Cl.
CPC ..... *E04B 1/61* (2013.01); *E04D 3/3607* (2013.01); *E04D 3/3608* (2013.01);

(Continued)

(58) Field of Classification Search
CPC ..... E04B 1/61; E04B 2/74; E04B 2002/7472; E04B 2103/06; E04D 12/004; E04D 3/3607; E04D 3/3608

(Continued)

(56) References Cited

U.S. PATENT DOCUMENTS 2,694,475 A * 11/1954 Crafton ..... E04B 5/10 52/578
4,063,395 A * 12/1977 Stewart ..... E04B 7/00 52/309.5

(Continued)

FOREIGN PATENT DOCUMENTS

DE 3338372 A1 * 4/1984 ..... B60J 7/003

*Primary Examiner* — Brian D Mattei
*Assistant Examiner* — Joseph J. Sadlon
(74) *Attorney, Agent, or Firm* — Jennifer Meredith, Esq.; Lippes Mathias Wexler Friedman LLP

(57) ABSTRACT

A retrofit roofing system with a roof furring having a substantially flat top and L-shaped side with openings that correspond to the raised portions of the existing metal roof panels, at least two fasteners that penetrate the L-shaped side through the existing metal roof panels and into the at least one roof perlins, a layer of adhesive on the substantially flat top portion of the roof furring; and at least one new metal roof panel on top of the layer of adhesive. There is also a new roofing system having at least two roof perlins with a bottom portion attached to a roof deck by fasteners and a top portion, a layer of adhesive attached to the top portion of the at least two roof perlins and a metal roofing panel on top of the layer of adhesive attached to the top portion of the at least two roof perlins.

12 Claims, 7 Drawing Sheets

Related U.S. Application Data continuation-in-part of application No. 14/724,950, filed on May 29, 2015, now Pat. No. 9,896,846.

(60) Provisional application No. 62/425,319, filed on Nov. 22, 2016.

(51) Int. Cl.
*E04D 3/36* (2006.01)
*E04B 2/74* (2006.01)

(52) U.S. Cl.
CPC ..... *E04D 12/004* (2013.01); *E04B 2/74* (2013.01); *E04B 2002/7472* (2013.01); *E04B 2103/06* (2013.01)

(58) Field of Classification Search
USPC ..... 52/506.05
See application file for complete search history.

(56) References Cited

U.S. PATENT DOCUMENTS 4,448,231 A * 5/1984 Salkeld ..... A47G 5/00 16/268
4,525,976 A * 7/1985 Simpson ..... E04D 3/362 52/127.7
5,010,702 A * 4/1991 Daw ..... E04B 2/7409 52/241
5,088,259 A * 2/1992 Myers ..... E04D 11/02 52/309.8
5,287,664 A * 2/1994 Schiller ..... E04B 2/7457 248/56
5,511,354 A * 4/1996 Eidson ..... E04D 3/3608 52/544
5,720,147 A * 2/1998 Wenrick ..... E04D 13/1643 52/745.06
5,861,105 A * 1/1999 Martineau ..... E04B 2/8652 249/190
5,884,446 A * 3/1999 Hageman ..... E04D 13/1643 52/408
6,000,180 A * 12/1999 Goodman ..... A47B 83/001 52/238.1
6,233,893 B1 * 5/2001 Lewis ..... E04C 5/04 52/318
6,751,914 B2 * 6/2004 Zeh ..... A47B 83/001 108/60
7,987,647 B2 * 8/2011 Rymell ..... E04D 3/3608 52/506.06
8,407,958 B2 * 4/2013 Kelly ..... E04D 13/155 52/409
10,815,657 B2 * 10/2020 Hortom ..... E04B 1/61 52/506.05
2004/0250482 A1 * 12/2004 Jacobson ..... E04B 1/24 52/79.1

* cited by examiner

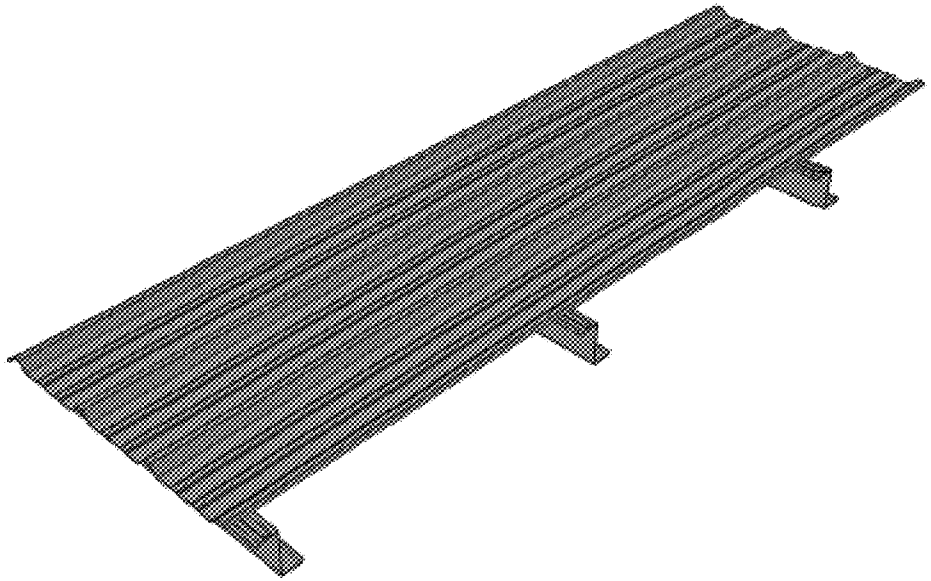
FIGURE 1
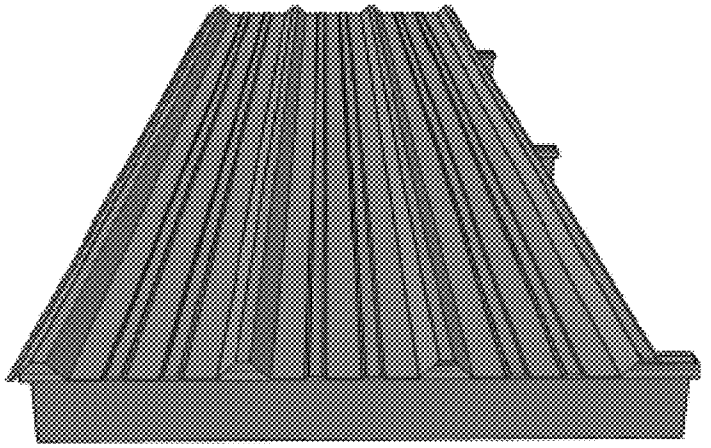
FIGURE 2
FIGURE 2B

METAL ROOFING SYSTEM

The present invention relates to metal roofing systems. This application is a continuation of application Ser. No. 15/819,078 filed Nov. 21, 2017 which is a continuation-in-part of Ser. No. 14/724,950 filed May 29, 2015 and which claims priority to provisional patent application 62/425,319 filed Nov. 22, 2016, the entire contents of each are incorporated herein by reference.

The present invention is utilized in lieu of the screw attached 6" metal plates which are the current industry attachment method. Each screw that penetrates the roof creates a potential source for leakage, oil canning. The present invention eliminates the need for holes in the metal roofing panels (no surface penetration) and allows for flexibility to prevent oil canning.

Another problem within the prior art is the need for a retrofit metal roofing system. Typically, a metal roof may not be installed over a pre-existing metal roof. The present invention solves this problem and allows for a retrofitted metal roof with no surface penetration and is also flexible, allowing for expansion and contraction panel movement without losing adhesion to the structural framing.

BRIEF SUMMARY OF THE INVENTION

According to one aspect of the present invention, a retrofit roofing system is provided with a roof furring that is above and runs substantially perpendicular to a set of raised portions that run the length of at least one existing metal roof panel, wherein the roof furring has a substantially flat top portion and at least one L-shaped side with openings which correspond to the raised portions of the at least one existing metal roof panel, wherein the openings that correspond to the raised portions of the at least one existing metal roof panel are semi-circular; wherein the at least one existing metal roof panel has at least one roof perlin under it and at least two fasteners that penetrate the L-shaped side through the at least one existing metal roof panel and into the at least one roof perlin; a layer of adhesive attached to the substantially flat top portion of the roof furring; and at least one new metal roof panel on top of the layer of adhesive, wherein the at least one new metal roof panel is attached by adhesive and is not penetrated by fasteners.

According to another aspect of the present invention, A retrofit roofing system, comprising: a roof furring that is above and runs substantially perpendicular to a set of raised portions that run the length of at least one existing metal roof panel, wherein the roof furring has a substantially flat top portion and at least one L-shaped side with openings which correspond to the raised portions of the at least one existing metal roof panel, wherein the openings the correspond to the raised portions of the at least one existing metal roof panel are an open bottom rectangle; wherein the at least one existing metal roof panel has at least one roof perlin under it and at least two fasteners that penetrate the L-shaped side through the at least one existing metal roof panel and into the at least one roof perlin; a layer of adhesive attached to the substantially flat top portion of the roof furring; and at least one new metal roof panel on top of the layer of adhesive, wherein the at least one new metal roof panel is attached by adhesive and is not penetrated by fasteners.

BRIEF DESCRIPTION OF THE DRAWINGS

FIGS. 1, 2 and 2B depict a new roofing installation according to the present invention.

DETAILED DESCRIPTION OF THE INVENTION

Figure 3:
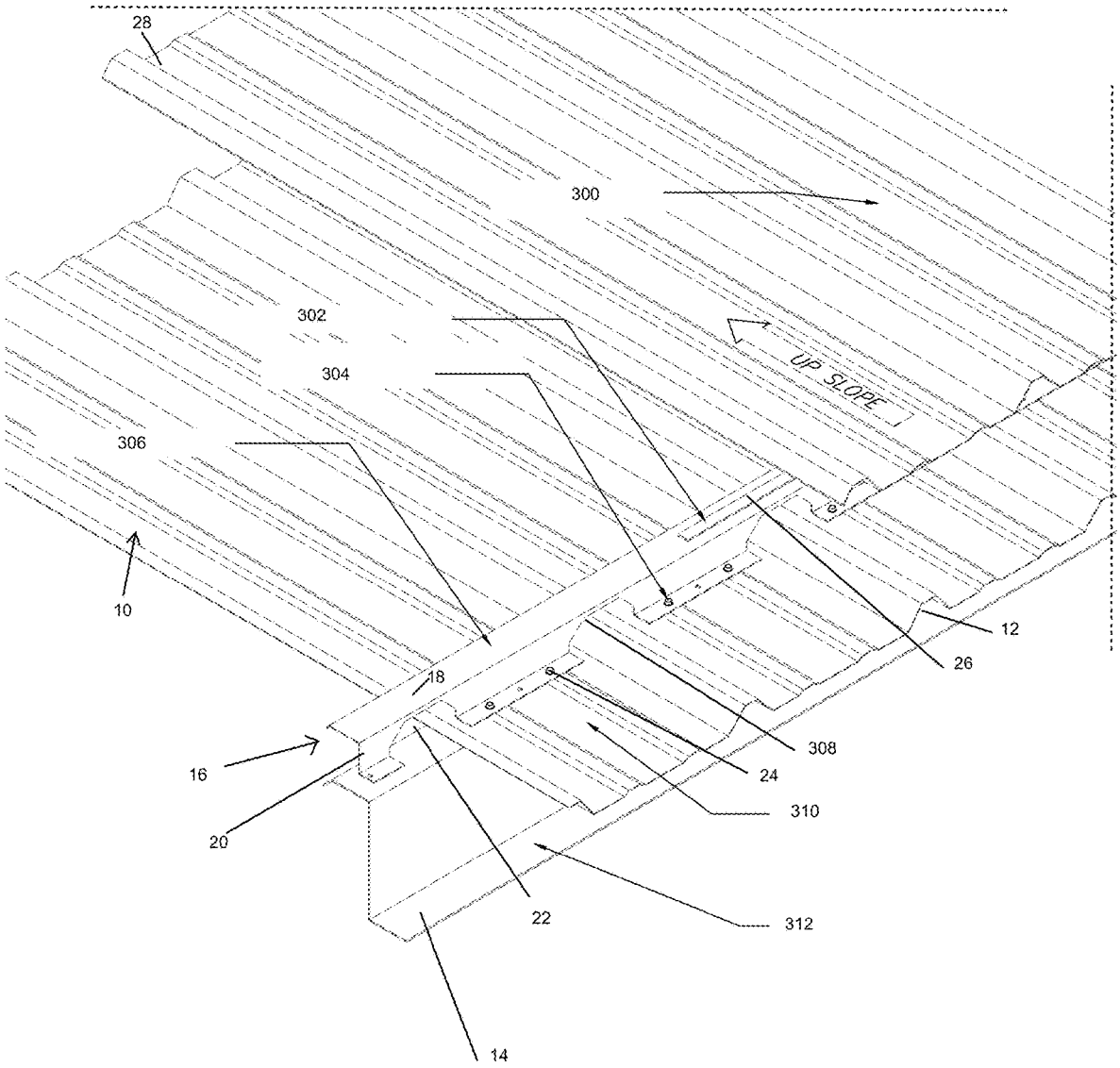
FIG. 3 depicts a retrofit roofing installation according to the present invention.
Figure 4:
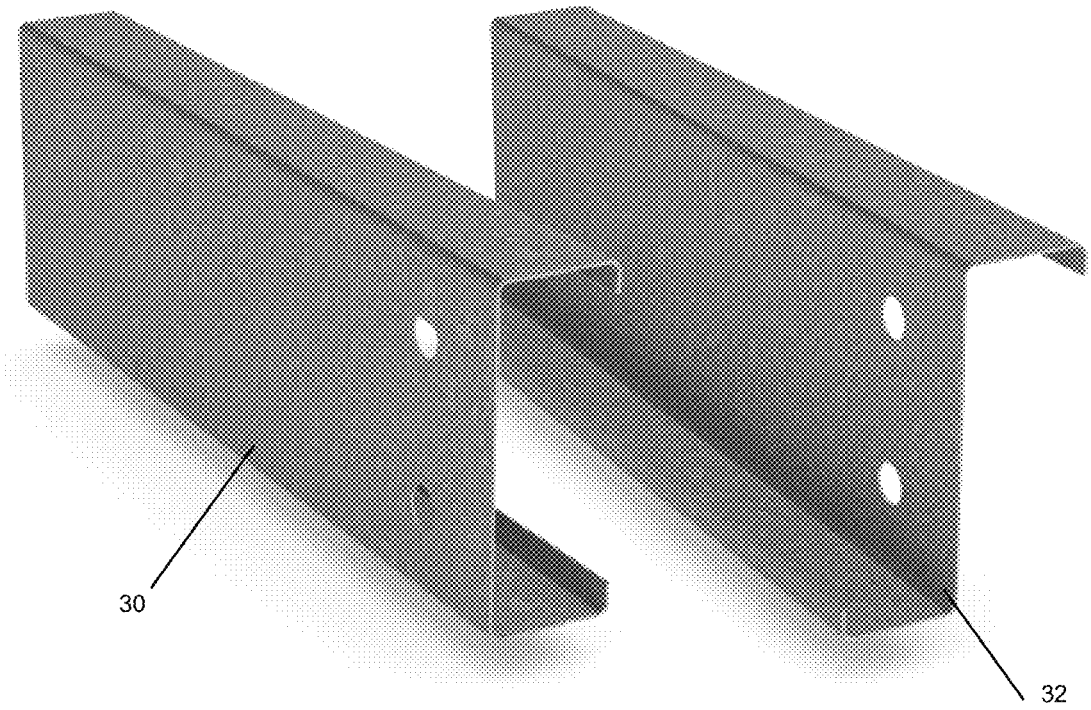
FIG. 4 depicts Cee and Zee purlins according to the present invention.

According to one aspect of the present invention, a retrofit roofing system is provided. As shown in FIGS. 1, 2, 2B, 3, 4, 5, 6, 7, 8 and 9, there may be at least one existing metal roof panel (10) with raised portions (12) that run the length of the at least one existing metal roof panel and at least one roof perlin (14) under each of the existing metal roof panels and attached to a roof deck; a roof furring (16) that runs substantially perpendicular to the raised portions, wherein the roof furring (16) has a substantially flat top portion (18) and at least one L-shaped side (20) with openings (22) that correspond to the raised portions (12) of the at least one existing metal roof panel; at least two fasteners (24) that penetrate the L-shaped side (20) through the at least one existing metal roof panel (10) and into the at least two roof perlins; a layer of adhesive (26) attached to the substantially flat top portion (18) of the roof furring (16); and at least one new metal roof panel (28) on top of the layer of adhesive (26). This creates a new metal roof without any fasteners or openings that penetrate the new metal roof surface. Also, the adhesive attachment allows for flexibility and avoid oil canning. The at least two roof perlins may be Cee purlins (30). These are called Cee purlins as they are substantially C shaped. The at least two roof perlins may also be Zee purlins (32). These are called Zee purlins as they are substantially Z shaped. The fasteners may be ring shank roofing nails. The layer of adhesive is selected from the group consisting of a foam adhesive, a urethane adhesive and sealant, one part polyurethane tube adhesive and sealant, two-part polyurethane tube adhesives including no rise, medium and high rise foam versions, Butyl adhesive and sealant tube, Butyl adhesive and sealant tape, epoxy, manusbond flex-weld 15 non-sag, two-part epoxies including no rise, low rise and medium rise foam adhesives, liquid nails, modified-bituminous adhesive tape and tar, TPO Adhesives, TPO self-adhering products, and non-bituminous peel and stick adhesives.

Figure 5:
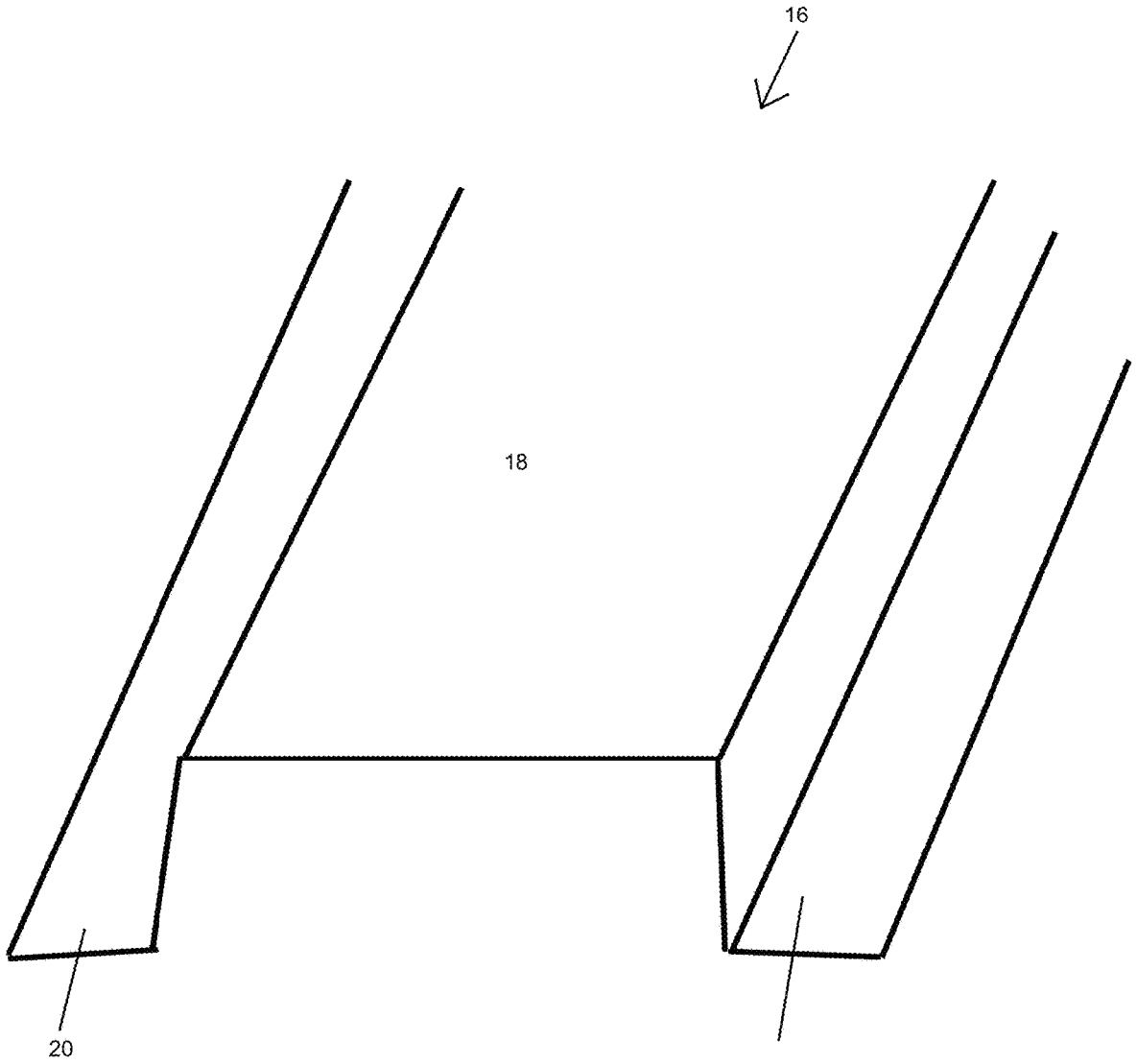
FIGS. 5-6 depict side views of the roof furrings according to the present invention.
Figure 6:
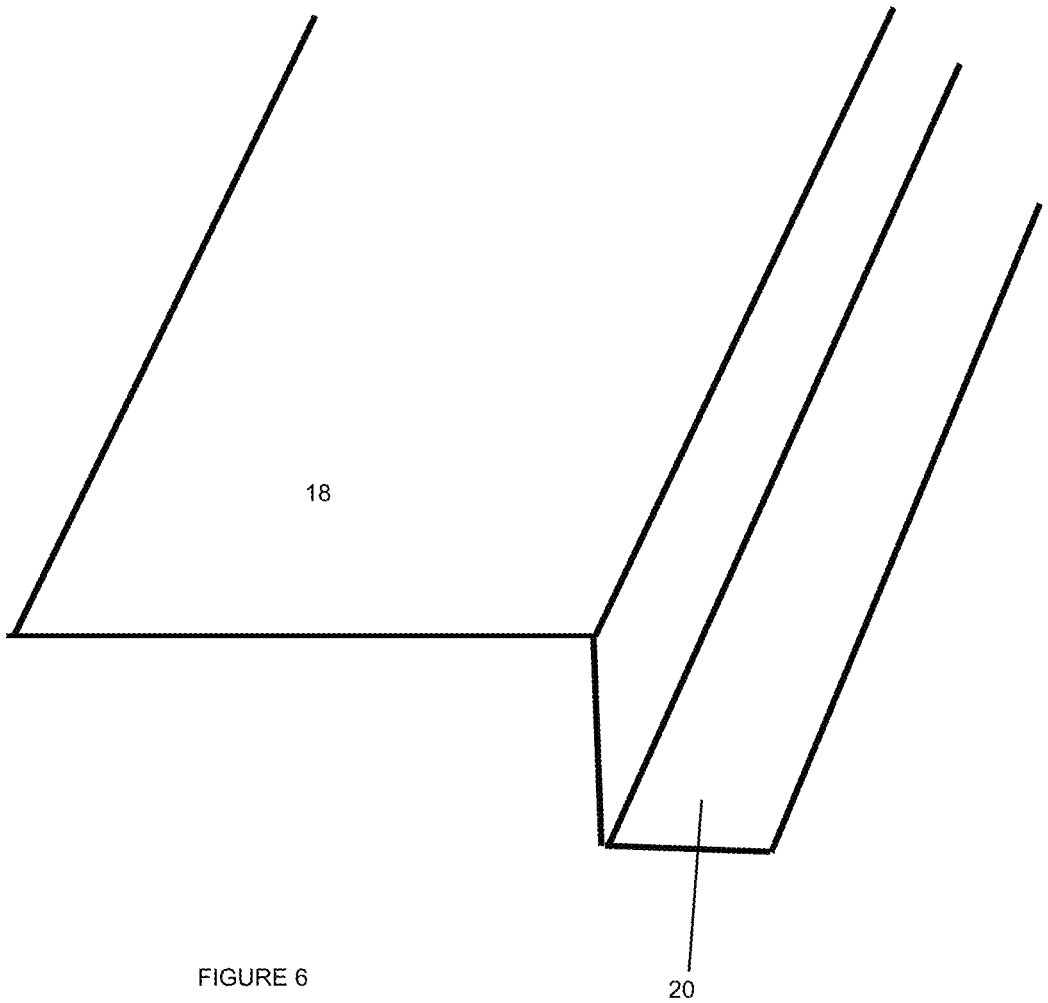
Figure 7:
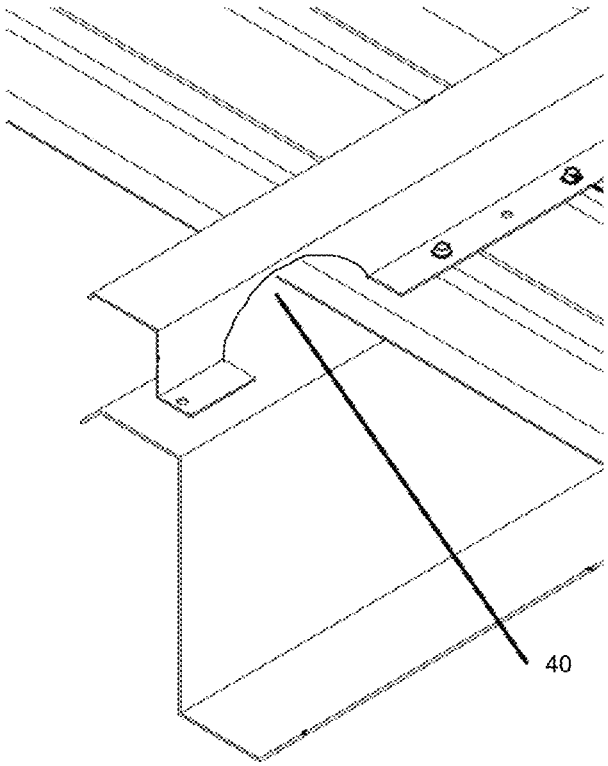
FIGS. 7-9 depict different openings according to the present invention.
Figure 8:
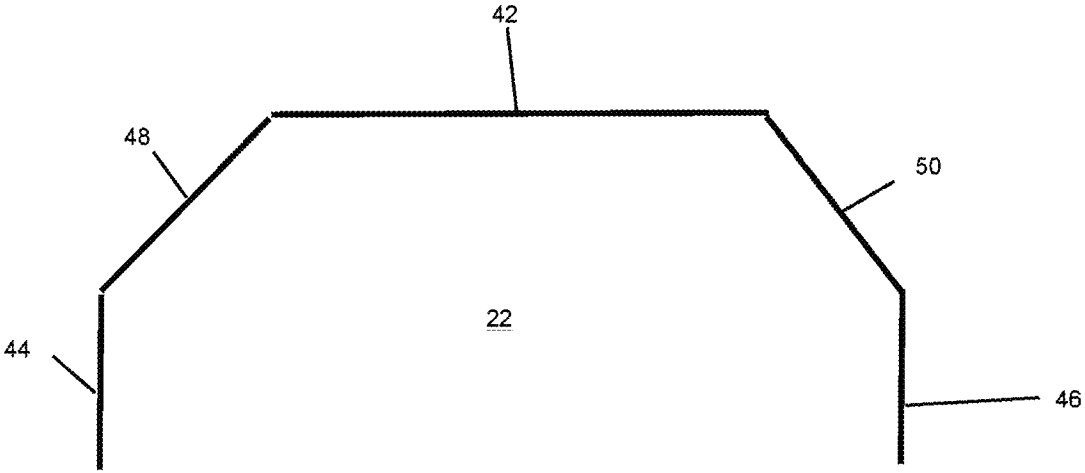
Figure 9:
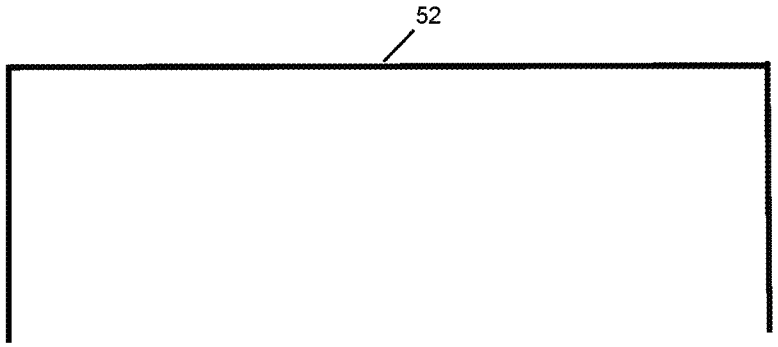

As shown in FIG. 5, the roof furring has two opposed L-shaped sides (20) with openings that correspond to the raised portions of the at least one existing metal roof panel. As shown in FIG. 6, there may be one L-shaped side (20). As shown in FIG. 7, the openings may also be a semi-circular shaped (40). As shown in FIG. 8, the openings (22) that correspond to the raised portions of the at least one existing metal roof panel have a top flat portion (42), two sides (44, 46) and two diagonal portions (48, 50) between each of the respective two sides (44, 46) and the top flat portion (42). As shown in FIG. 9, the openings the correspond to the raised portions of the at least one existing metal roof panel may also be an open bottom rectangle (52).

As shown in FIGS. 1-2, a new roofing system may be provided. The system may have a roof deck; at least two roof perlins (100) having a bottom portion (102) and a top portion (104), wherein the bottom portion (102) is attached to the roof deck. The bottom portion may be attached by fasteners, such as ring shank roofing nails, or adhesive. A layer of adhesive (106) is attached to the top portion (104) of the at least two roof perlins. A metal roofing panel (108) is placed on top of the layer of adhesive (106) attached to the top portion of the at least two roof perlins. In this way, a metal roofing panel system is provided with no penetration of the top roof deck. Previously, nails were screwed through the top layer of the roof deck which created openings for potential leaks. The roof perlins may be Cee purlins or Zee purlins. The layer of adhesive may be selected from the group consisting of a foam adhesive, a urethane adhesive and sealant, one part polyurethane tube adhesive and sealant, two-part polyurethane tube adhesives including no rise, medium and high rise foam versions, Butyl adhesive and sealant tube, Butyl adhesive and sealant tape, epoxy, manus-bond flex-weld 15 non-sag, two-part epoxies including no rise, low rise and medium rise foam adhesives, liquid nails, modified-bituminous adhesive tape and tar, TPO Adhesives, TPO self-adhering products, and non-bituminous peel and stick adhesives.

The present invention utilizes a larger flat surface area for superior adhesion of roofing system materials. The system provides contractors with adhesive attachment in lieu of exposed thru panel screws or clips to attach metal roofing panels systems to roof decks. The system eliminates all field exposed metal roofing screws, dramatically cuts metal roofing installation time and expensive labor, eliminates the need to measure for accurate screw fastener placement, joins the metal roofing panel system material within 10 minutes, reduces corrosive staining screw shavings to sweep off, reduces the effects of cross panel tensioning (oil canning) and allows metal roofing to lay flat without screw fastener dimpling.

It should be understood that the foregoing relates to preferred embodiments of the invention and that modifications may be made without departing from the spirit and scope of the invention as set forth in the following claims.

I claim:

1. A retrofit roofing system, comprising:

a roof furring that is above and runs substantially perpendicular to a set of raised portions that run the length of at least one existing metal roof panel, wherein the roof furring has a substantially flat top portion and at least one L-shaped side with openings which correspond to the raised portions of the at least one existing metal roof panel, wherein the openings that correspond to the raised portions of the at least one existing metal roof panel are semi-circular;

wherein the at least one existing metal roof panel has at least one roof perlin under it and at least two fasteners that penetrate the L-shaped side through the at least one existing metal roof panel and into the at least one roof perlin;

a layer of adhesive attached to the substantially flat top portion of the roof furring; and at least one new metal roof panel on top of the layer of adhesive, wherein the at least one new metal roof panel is attached by adhesive and is not penetrated by fasteners.

2. A roofing system as in claim 1, wherein the roof perlins are Cee purlins.

3. A roofing system as in claim 1, wherein the roof perlins are Zee purlins.

4. A roofing system as in claim 1, wherein the fasteners are ring shank roofing nails.

5. A roofing system as in claim 1, wherein the layer of adhesive is selected from the group consisting of a foam adhesive, a urethane adhesive and sealant, one part polyurethane tube adhesive and sealant, two-part polyurethane tube adhesives including no rise, medium and high rise foam versions, Butyl adhesive and sealant tube, Butyl adhesive and sealant tape, epoxy, manus-bond flex-weld 15 non-sag, two-part epoxies including no rise, low rise and medium rise foam adhesives, liquid nails, modified-bituminous adhesive tape and tar, TPO Adhesives, TPO self-adhering products, and non-bituminous peel and stick adhesives.

6. A roofing system as in claim 1, wherein the roof furring has two opposed L-shaped sides with openings that correspond to the raised portions of the at least one existing metal roof panel.

7. A retrofit roofing system, comprising:

a roof furring that is above and runs substantially perpendicular to a set of raised portions that run the length of at least one existing metal roof panel, wherein the roof furring has a substantially flat top portion and at least one L-shaped side with openings which correspond to the raised portions of the at least one existing metal roof panel, wherein the openings which correspond to the raised portions of the at least one existing metal roof panel are an open bottom rectangle;

wherein the at least one existing metal roof panel has at least one roof perlin under it and at least two fasteners that penetrate the L-shaped side through the at least one existing metal roof panel and into the at least one roof perlin;

a layer of adhesive attached to the substantially flat top portion of the roof furring; and at least one new metal roof panel on top of the layer of adhesive, wherein the at least one new metal roof panel is attached by adhesive and is not penetrated by fasteners.

8. A roofing system as in claim 7, wherein the roof perlins are Cee purlins.

9. A roofing system as in claim 7, wherein the roof perlins are Zee purlins.

10. A roofing system as in claim 7, wherein the fasteners are ring shank roofing nails.

11. A roofing system as in claim 7, wherein the layer of adhesive is selected from the group consisting of a foam adhesive, a urethane adhesive and sealant, one part polyurethane tube adhesive and sealant, two-part polyurethane tube adhesives including no rise, medium and high rise foam versions, Butyl adhesive and sealant tube, Butyl adhesive and sealant tape, epoxy, manus-bond flex-weld 15 non-sag, two-part epoxies including no rise, low rise and medium rise foam adhesives, liquid nails, modified-bituminous adhesive tape and tar, TPO Adhesives, TPO self-adhering products, and non-bituminous peel and stick adhesives.

12. A roofing system as in claim 7, wherein the roof furring has two opposed L-shaped sides with openings that correspond to the raised portions of the at least one existing metal roof panel.

* * * * *